United States Patent [19]

Pringle et al.

[11] 4,362,214

[45] Dec. 7, 1982

[54] TUBING RETRIEVABLE VARIABLE SETTING DIFFERENTIAL PRESSURE ACTUATED WELL SAFETY VALVE

[75] Inventors: Ronald E. Pringle, Houston; Arthur J. Morris, Magnolia, both of Tex.

[73] Assignee: Camco, Incorporated, Houston, Tex.

[21] Appl. No.: 226,295

[22] Filed: Jan. 19, 1981

[51] Int. Cl.[3] ..... E21B 34/10

[52] U.S. Cl. ..... 166/322; 166/237; 285/12

[58] Field of Search ..... 166/217, 322, 323, 324, 166/316, 237; 285/12; 138/44

[56] References Cited

U.S. PATENT DOCUMENTS

| | | | |
|---|---|---|---|
| 2,804,928 | 9/1957 | Farrar | 138/44 |
| 3,045,760 | 7/1962 | Moore, Jr. | 166/324 |
| 3,240,511 | 3/1966 | Bishop et al. | 166/377 |
| 4,289,202 | 9/1981 | Henderson | 166/212 |

*Primary Examiner*—William F. Pate, III

*Attorney, Agent, or Firm*—Fulbright & Jaworski

[57] ABSTRACT

A tubing retrievable differential pressure operated well safety valve which closes at a predetermined rate of flow which may be changed from the well surface. A housing is adapted to be threadedly connected to well tubing. A spring forces a flow tube and choke bean downwardly to normally hold the valve open, but when the producing rate increases to a preset value the bean and flow tube moves upwardly overcoming the spring allowing the valve to close. A releasable connection is provided between the choke bean and the flow tube for connecting the choke bean to and releasing the choke bean from the flow tube by longitudinal movement of the bean relative to the flow tube. The connection may include a collet interconnecting the beam and the flow tube in which the collet includes an enlargement for engaging a recess in the bean. The flow tube includes a backup shoulder for locking the enlargement in the recess and also includes an opening for allowing the collet to become released from the bean. Spring means between the flow tube and the collet yieldably urge the collet enlargement on to the shoulder. A chamber between the flow tube and the housing is connected by a fluid passageway from the bore having a restriction and a piston on the flow tube is positioned in the chamber and is retarded by restricted flow of fluid from the chamber.

6 Claims, 4 Drawing Figures

TUBING RETRIEVABLE VARIABLE SETTING DIFFERENTIAL PRESSURE ACTUATED WELL SAFETY VALVE

BACKGROUND OF THE INVENTION

It is old, as disclosed in U.S. Pat. No. 3,045,760, to provide a wireline retrievable differential pressure operated safety valve adjusted to close at a predetermined rate of flow. The predetermined rate of flow may be adjusted by changing the coil spring, adjusting the number of spring spacer rings used, or changing the size of the choke.

Generally, well production changes with time and it is desirable to change or adjust the valve to close at a different rate of flow as the well production changes. This can be accomplished easily with the wireline retrievable safety valve of the prior art which is releasably locked in the well tubing and can be removed and adjusted.

However, it would be desirable to utilize a tubing retrievable safety valve, that is, one which is threaded into and forms part of the well tubing because the tubing retrievable type valve provides a larger through bore. However, the closing force of a tubing retrievable safety valve can not easily be changed except by pulling the well tubing which is undesirable and is not commercially feasible.

The present invention is directed to an improved tubing differential pressure actuated tubing retrievable well safety valve in which the closing forces can be adjusted from the well surface as the need arises.

SUMMARY

The present invention is directed to a tubing retrievable differential pressure actuated well safety valve in which the valve parameters are preset so that a predetermined increase in the well production flow velocity will cause the safety valve to close. The valve generally includes a housing adapted to be threadedly connected to well tubing and having a bore therethrough. A valve element is connected to the housing and is movable between open and closed positions in the bore. A flow tube is longitudinally movable in the housing for controlling the opening and closing of the valve element with spring means positioned between the housing and the flow tube for moving the tube in a direction to bias the valve element in the open position. A choke bean is connected to the flow tube and creates a pressure differential and force which acts against the spring tending to cause the valve to close. The present invention is particularly directed to providing a releasable connecting means between the bean and the flow tube whereby the choke bean may be connected to and released from the flow tube by longitudinal movement of the bean relative to the flow tube thereby allowing the choke bean to be retrieved and a different size bean inserted for changing the rate of flow at which the valve is set to close.

Yet a further object of the present invention is wherein the releasable connecting means between the bean and the flow tube includes collet means interconnecting said bean and said flow tube in one longitudinal position and releasing said bean from said flow tube in a second longitudinal position.

Still a further object of the present invention is wherein the bean includes an annular recess and the collet includes an enlargement for engaging the recess, and the flow tube includes a backup for locking the enlargement in the recess and also includes an opening for receiving the enlargement and allowing the collet to become released from the bean. The bean may also include a slip ring for aiding the release from the collet.

Still a further object is the provision of spring means between the flow tube and the collet for yieldably urging the collet enlargement on to the backup for holding the bean connected to the flow tube.

Another problem is that a small slug of liquid flowing through the safety valve can encounter the bean and create a sufficient pressure differential to undesirably close the safety valve.

The present invention further includes means for providing a requirement that the differential pressure must exist for a predetermined time before the safety valve closes. Thus, a chamber may be provided between the flow tube and the housing with a fluid passageway from the bore to the chamber having a restriction therein for allowing the passage of liquids in the bore to and from the chamber. A piston on the flow tube is positioned in the chamber. By restricting the flow of fluid from the chamber the longitudinal movement of the flow tube is restricted for a predetermined time until the liquid passes through the restriction. However, a slug of liquid will not act on the bean for the time required for the piston to move sufficiently to allow closure of the safety valve.

Other and further objects, features and advantages will be apparent from the following description of a presently preferred embodiment of the invention, given for the purpose of disclosure and taken in conjunction with the accompanying drawings.

BRIEF DESCRIPTION OF THE PREFERRED EMBODIMENT

Figure 1A:
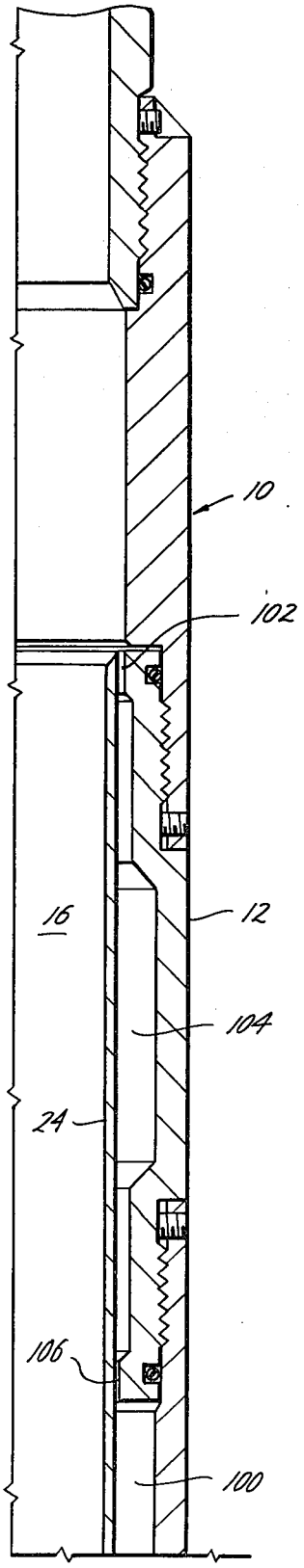
FIGS. 1A, 1B and 1C are continuations of each other and are fragmentary, cross-sectional views of the safety valve of the present invention shown in the open position.
Figure 1B:
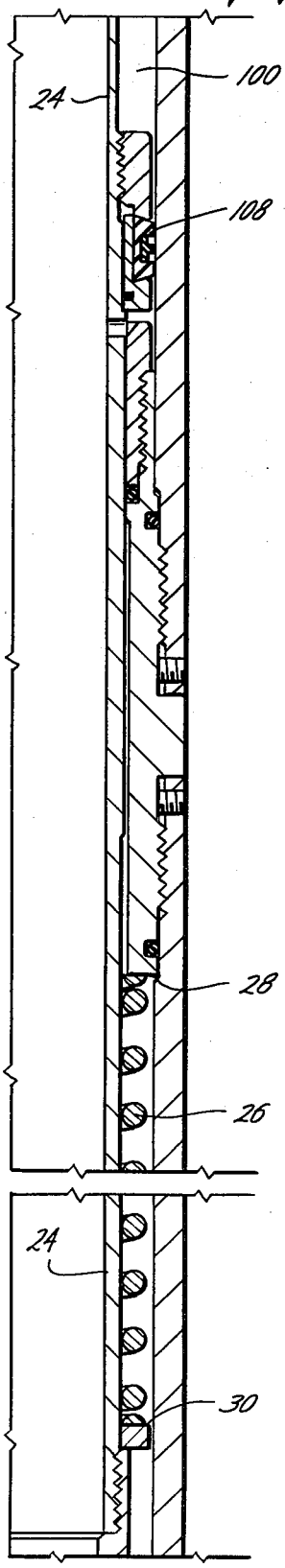
Figure 1C:
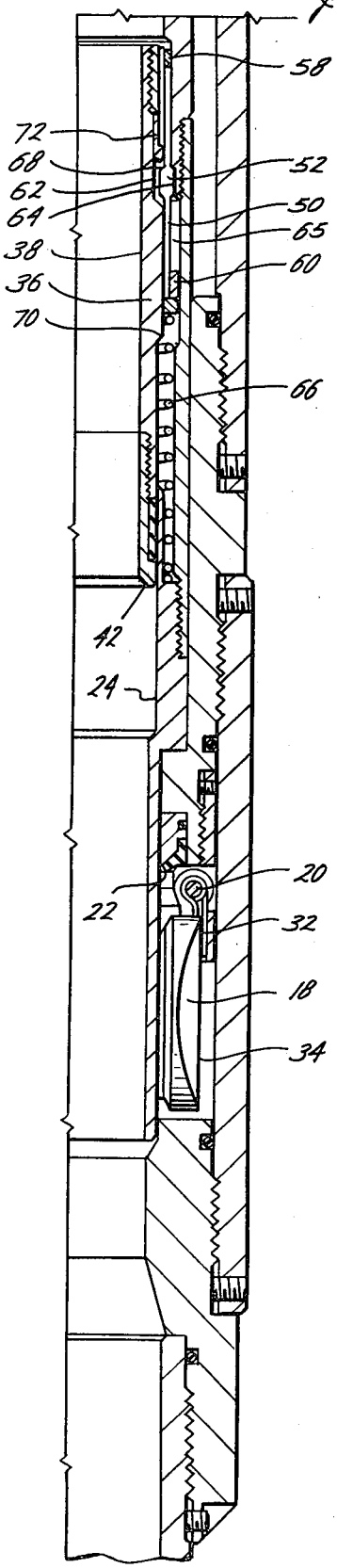

Referring now to the drawings, particularly to FIGS. 1A–1C, the reference numeral 10 generally indicates the tubing retrievable safety valve of the present invention which includes a housing 12 adapted to have a threaded connection (not shown) for connecting the valve 10 to a tubing instead of inside a tubing as in a wireline retrievable safety valve. This allows the diameter of the valve 10 to be increased and consequently provides an increased size bore 16 therethrough which is desirable for reducing sand cutting, minimizing turbulence and allowing increased production.

Any suitable type of valve element, such as flapper element 18, is provided connected to the housing on a pivot 20 which is movable from an open position as shown in FIG. 1C to a closed position seated on a valve seat 22 for blocking flow upwardly through the valve 10 through the bore 16. A flow tube 24 is longitudinally movable in the housing 12 for controlling the opening and closing of the valve element 18. Spring means 26 acts between a shoulder 28 on the housing 12 and a shoulder 30 on the flow tube 24 to yieldably urge the flow tube 24 downwardly in a direction to engage and move the valve element 18 to an open position. When the flow tube 24 is moved upwardly, the flapper valve 18 is freed for closure. A torsional spring 32 acting on the element 18 forces the flapper 18 to swing upwardly and engage the valve seat 22. The closure of the flapper element 18 is also obtained by well production in the housing 12 acting on the back 34 of the flapper valve 18.

A choke bean 36 is provided in the bore 16 connected to the flow tube 24 having an internal diameter 38 which creates a differential pressure across the bean 36. Thus when the well production flow velocity through the bean 36 increases to a predetermined amount, the pressure acting against the bottom 42 causes the bean 36 to move upwardly overcoming the force of the spring 26 and carries the flow tube 24 upwardly to allow the valve element 18 to close.

Of course, the safety valve 10 must be adjusted to close at a predetermined rate of flow based upon the particular parameters of the well in which it is to be used in order to adjust the opening and closing forces acting on the flow tube 24. However, after a period of time of production from the well, well production changes and it is desirable to change the setting of the safety valve to close at a different predetermined rate of flow. With a wireline retrievable type safety valve, the safety valve is generally retrieved to the well surface and adjustments made by changing such factors as the coil spring 26, adding or subtracting spacer rings acting on the spring 26, or changing the choke bean 36. However, it is not feasible to retrieve the safety valve 10 since it is connected in the tubing and would require that the entire tubing be pulled, which is undesirable.

The present invention is directed to providing a tubing retrievable differential pressure actuated safety valve which can be adjusted to change it to close at a different rate of flow.

The present invention is directed to changing the closing force by changing the size of a choke bean 36 while the valve is in place. Thus the present invention provides a releasable connecting means between the bean 36 and the flow tube 24 for connecting a bean 36 to and releasing a bean 36 from the flow tube by longitudinal movement of the choke bean 36 relative to the flow tube 24.

The releasable connecting means 50 may include collet means interconnecting the choke bean 36 and the flow tube 24. The collet 50 in one longitudinal position connects the bean 36 to the flow tube 24. In a second longitudinal position of the collet 50, the bean 36 may be removed and a different bean 36 can then be inserted having a different internal diameter 38 which changes the pressure drop across the bean 36 for closing the valve 10 at a different well flow velocity.

The collet 50 includes an enlargement 52 connected by longitudinally extending fingers 54 and 56 to end rings 58 and 60, respectively. The choke bean 36 includes an annular recess 62 which is adapted to engage the enlargement 52 for securing the bean 36 to the flow tube 24. The flow tube 24 includes a backup shoulder 64 for holding the enlargement 52 in the recess 62. The flow tube 24 also includes an opening 65 into which the enlargement 52 may be received for releasing the bean 36. Normally, a spring 66 urges the collet 50 upwardly to hold the enlargement 52 against a stop shoulder 68 whereby the shoulders 64 and 68 keep the enlargement 52 in the annular recess 62. However, the collet 50 and the bean 36 may be forced downwardly against the spring 66 to place the enlargement 52 in registry with the opening 65 and an upward movement of the bean 36 relative to the collet 50 will force the enlargement 52 into the opening 65 and release the bean 36 for removal from the valve 10. Similarly, a new bean 36 may be inserted by moving a new bean 36 downwardly relative to the flow tube 24 in which a shoulder 70 on the bean will carry the enlargement 52 into registry with the opening 65 and allow the bean 36 to move downwardly relative to the enlargement 52 until the enlargement 52 falls in the recess 62. Thereafter, upward movement of both the collet 50 and the bean 36 will place the bean 36 in the connected position shown in FIG. 1C.

Figure 2:
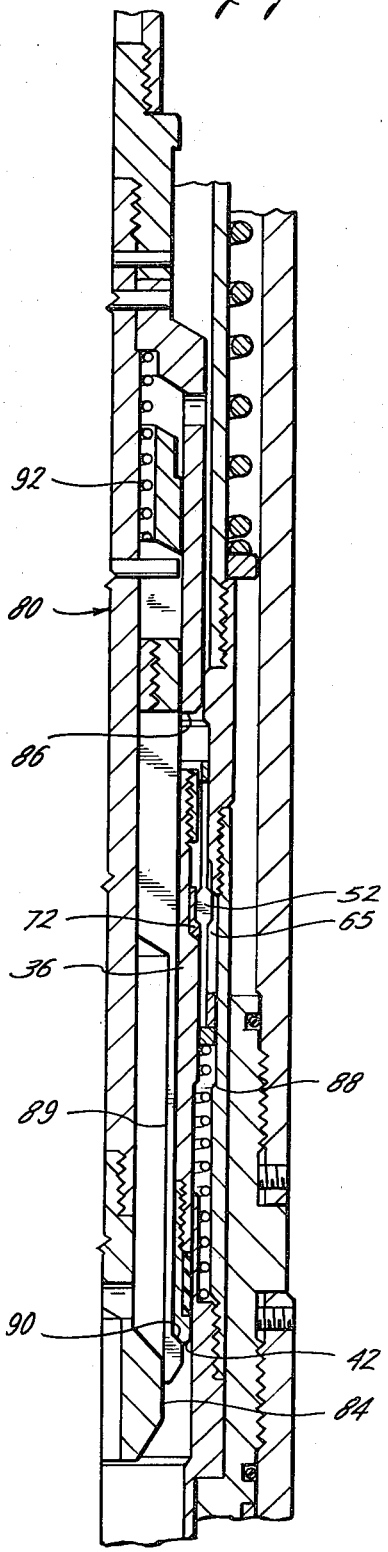
FIG. 2 is a view similar to FIG. 1B showing a tool removing the choke beam from the safety valve.

The bean 36 includes a slip ring 72 longitudinally movable in the recess 62 to aid in the removal of the bean 36. When the bean 36 is inserted downwardly into the bore 16 of the valve 10, the collet enlargement 52 will engage the slip ring 72 pushing the ring 72 towards the top of the recess 62 and allowing the enlargement 52 to enter the recess 62 and lock the bean 36 to the flow tube 24. In releasing the bean 36, the bean is driven downwardly carrying the slip ring 72 downwardly past the enlargement 52 as the enlargement 52 is pressed into opening 65, and on upward movement of the bean 36 the slip ring moves to the lower portion of the recess 62 and engages the interior of the enlargement 52 as best seen in FIG. 2. This prevents the enlargement 52 from moving against the backup shoulder 64 and thus allows the bean 36 to be pulled upwardly past the enlargement 52.

While any suitable type of wireline tool may be used to release the choke bean 36 the tool generally indicated by the reference numeral 80, as best seen in FIG. 2, can be used. The tool 80 includes a housing 82 which includes a backup shoulder 84. A plurality of longitudinally movable collet fingers 88 which include hooks 90 are slidably carried by the housing 82. A spring 92 is provided between the housing 82 and the collet 88 for moving the collet fingers 88 downwardly relative to the housing 82. When the tool 80 is lowered into the bore 16 of the well tool 10, the collet fingers 88 will contact the bean 36, move upwardly overcoming spring 92 and deflect through the interior 38 of the choke bean 36. After passing through the bean 36 fingers 88 will move below the bottom 42 of the choke bean and seat on shoulder 84. The edge 86 of the housing 82 will contact and move the choke bean 36 and collet 50 downwardly until the enlargement 52 is in registry with the opening 65 overcoming the spring 66. The collet 50 will stop when it reaches the shoulder 88 and downwardly jarring on the tool 80 will cause slip ring 72 to move. Upward movement of the tool 80 will cause the slip ring 72 to engage the enlargement 52 and prevent the enlargement from moving into the recess 62 and against the backup shoulder 64. Further upward movement of the tool causes the enlargement 52 to be pressed into the opening 65 and allows complete removal of the bean 36. Another choke bean 38 may be moved downwardly by any suitable tool and inserted in the valve 10.

While it is desired that the valve 10 close upon a predetermined rate of gas flow through the valve 10, the gas may at times include a small slug of liquid which can encounter the bean 36 and create a sufficient pressure differential to undesirably close the safety valve. The present invention further includes means for providing a requirement that the differential pressure existing across the choke bean 36 must exist for a predetermined amount of time before the safety valve 10 closes. Thus, referring to FIG. 1A, a liquid chamber 100 is provided in which liquid may be inserted or collect therein from the bore 16 through opening 102. A fluid passageway 104 is provided from the bore 16 through the opening 102 to the chamber 100 through a restriction 106. A piston 108 is provided on the flow tube 24 and positioned in the chamber 100. When the valve is in the open position and when a differential pressure exists across the choke bean 36 for a predetermined amount of time, the flow tube 24 and piston 108 will move upwardly until liquid in the chamber 100 moves through the restriction 106 after which the valve 10 will close. However, a small slug of liquid will not act on the choke bean 36 for a sufficient length of time to cause the piston 108 to move upwardly sufficiently to cause the valve to close.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A tubing retrievable differential pressure actuated well safety valve comprising, a housing adapted to be threadably connected to well tubing, and having a bore therethrough, a valve element connected to the housing and movable between open and closed positions in the bore, a flow tube longitudinally movable in the housing for causing the opening and closing of the valve element, spring means positioned between the housing and the flow tube for moving the tube in a direction to open the valve element, a choke bean, longitudinally actuated non-threaded releasable connecting means between the bean and the flow tube for connecting the choke bean to and releasing the choke bean from the flow tube by longitudinal movement of the bean relative to the flow tube while the valve is positioned in a well.

2. The apparatus of claim 1 wherein the connecting means includes, collet means interconnecting said bean and said flow tube in one longitudinal position and releasing said bean from said flow tube in a second longitudinal position.

3. The apparatus of claim 2 wherein the bean includes an annular recess, the collet includes an enlargement for engaging the recess, and the flow tube includes a backup for backing the enlargement in said recess and also includes an opening for receiving the enlargement for allowing the collet to become released from the bean.

4. The apparatus of claim 3 including, spring means between the flow tube and the collet for yieldably urging the collet enlargement onto the backup.

5. The apparatus of claim 3 including, a slip ring slidably positioned in the recess for engagement by the enlargement.

6. The apparatus of claim 1 including, a chamber between the flow tube and the housing, a fluid passageway from the bore to said chamber having a restriction therein and allowing the passage of fluids in the bore to and from the chamber, a piston on the flow tube positioned in the chamber whereby movement of the flow tube is retarded as fluid is expelled from the chamber through the restriction.

* * * * *